US005954289A

United States Patent [19]

Hermanns et al.

[11] Patent Number: 5,954,289

[45] Date of Patent: Sep. 21, 1999

[54] METHOD AND APPARATUS FOR MAINTAINING CONSTANT WINDING DENSITY IN THE PRODUCTION OF YARN PACKAGES

[75] Inventors: Ferdinand Hermanns, Erkelenz, Germany; Urs Meyer, Zürich, Switzerland

[73] Assignee: W. Schlafhorst AG & Co., Germany

[21] Appl. No.: 08/884,153

[22] Filed: Jun. 26, 1997

[30] Foreign Application Priority Data

Jun. 26, 1996 [DE] Germany ..... 196 25 513

[51] Int. Cl.[6] ..... B65H 54/38; B65H 54/28

[52] U.S. Cl. ..... 242/477.8; 242/481.8

[58] Field of Search ..... 242/18.1, 18 DD, 242/36, 477.8, 477.7, 481.8

[56] References Cited

U.S. PATENT DOCUMENTS

| | | | |
|---|---|---|---|
| 4,696,435 | 9/1987 | Hermanns | 242/18.1 |
| 4,715,548 | 12/1987 | Miyake et al. | 242/36 X |
| 4,828,191 | 5/1989 | Ruge et al. | 242/18 DD X |
| 4,964,582 | 10/1990 | Hermanns et al. | 242/18 DD X |
| 5,112,000 | 5/1992 | Derichs et al. | 242/18.1 X |
| 5,141,169 | 8/1992 | Sugioka . | |
| 5,639,037 | 6/1997 | Marangone et al. | 242/18.1 |

FOREIGN PATENT DOCUMENTS

| | | |
|---|---|---|
| 1 286 782 | 1/1969 | Germany . |
| 2 330 650 | 1/1974 | Germany . |
| 39 04 065 | 8/1989 | Germany . |
| 39 11 854 A1 | 11/1989 | Germany . |
| 39 42 685 A1 | 6/1991 | Germany . |
| 41 25 310 A1 | 2/1992 | Germany . |
| 42 39 579 A1 | 5/1994 | Germany . |
| 44 13 549 A1 | 11/1994 | Germany . |
| 44 14 517 A1 | 12/1994 | Germany . |
| 44 31 333 A1 | 3/1996 | Germany . |

*Primary Examiner*—Michael Mansen
*Attorney, Agent, or Firm*—Kennedy Covington Lobdell & Hickman

[57] ABSTRACT

A method of producing a random wound yarn package includes driving a yarn package with a friction roller, setting and maintaining a constant yarn tension in the yarn, setting and maintaining a constant contact force between the friction roller and the yarn package being driven thereby, and temporarily regulating the yarn tension and the contact force during a time of a pattern winding zone of the winding process in order to maintain a constant winding density both before and during the time of the pattern winding zone. The winding station includes a friction roller for driving the yarn package, a yarn tensioner, a device that generates a constant contact force between the yarn package and the friction roller, and an evaluation and regulation unit that temporarily regulates the yarn tension generated by the yarn tensioner and the contact force generated by the device during the time of the pattern winding zone. A program of the evaluation and regulation unit regulates the yarn tension and the contact force by predetermined amounts and at predetermined times. Alternatively, yarn application representative of winding density is calculated based upon circumferential velocity, angular velocity, period, and/or frequency of the yarn package and friction roller continuously detected by sensors, and the yarn tension and contact force are regulated when the calculated yarn application deviates from a set value.

18 Claims, 2 Drawing Sheets

METHOD AND APPARATUS FOR MAINTAINING CONSTANT WINDING DENSITY IN THE PRODUCTION OF YARN PACKAGES

FIELD OF THE INVENTION

The present invention relates to a method and an apparatus for the production of random wound yarn packages at a winding station of a winding machine having a yarn tensioner for the tensioning of the yarn wound onto the yarn package and/or a device for generating a contact force between the yarn package and a friction roller and, in particular, relates to such a method and apparatus wherein an evaluation and regulation unit monitors the winding density of the yarn package during pattern winding zones of the winding process and regulates the yarn tension and/or contact force during the pattern winding zones in order to maintain a constant winding density throughout the winding process.

BACKGROUND OF THE INVENTION

Winding density is an important characteristic of a yarn package because it is indicative of the quality thereof. For instance, a yarn package having large fluctuations in the winding density during the winding process encounters significant problems during further processing such as dyeing and, particularly, unwinding.

Modern winding stations, particularly those in automatic winding machines, include devices for keeping the winding density of the randomly wound yarn package constant throughout most of the winding process. For example, it is known to compensate the contact force with which the yarn package rests on the friction roller driving it. It is also known to keep the yarn tension with which the yarn is wound onto the yarn package constant and, in particular, this method of maintaining a constant yarn tension results in a relatively uniform winding density.

Nevertheless, periods of increased winding density are encountered in spite of yarn tension maintenance and in spite of compensation of the contact force as a result of so-called pattern winding zones of the winding process. Moreover, increases in the winding density occur even when pattern disruption methods are employed, such as, for example, by alternatively accelerating the friction roller with slippage between the friction roller and the yarn package, and decelerating the friction roller without slippage between the friction roller and the yarn package. Hence, there remains a need for a method and an apparatus by which changes in the winding density resulting from pattern winding zones can be minimized.

OBJECTIVE AND SUMMARY OF THE INVENTION

An objective of the present invention is to further improve the maintenance of a constant winding density of a yarn package during winding and to prevent as much as possible a change in the winding density and, particularly, an increase in the winding density during pattern winding zones of the winding process.

This objective is attained by the present invention through regulation of the yarn tension and/or the contact force during at least one pattern winding zone of the winding process whereby a substantially constant winding density is achieved both during the pattern winding zone and outside of the pattern winding zone. In particular, the yarn tension and/or the contact force are reduced in at least one time interval during which a pattern winding zone occurs, and preferably the yarn tension is reduced by relaxation of the yarn tensioner and/or a reduction in the winding speed of the friction roller.

In one feature of the present invention the regulation of the yarn tension and/or the contact force takes place in accordance with a predetermined program when a pattern winding zone is encountered in the winding process. For example, it is possible to determine empirically by tests or by calculations how much the yarn tension and/or the contact force should be reduced in order to adjust the winding density experienced during a pattern winding zone to that experienced when the pattern winding zone is absent. An instruction regarding the course of this reduction can be stored in a program in an evaluation and regulation unit of the winding station and be called up from a time prior to the pattern winding zone until a time after the pattern winding zone.

In another feature of the present invention the time of at least one pattern winding zone is precalculated and recorded in an evaluation and regulation unit of the winding station. However, a pattern winding zone can alternatively be detected during the actual winding process such as, for example, by detection and evaluation of the angular velocities of the friction roller and the yarn package as taught by German Patent Publication DE 42 39 579 A1.

In yet another feature of the present invention the winding density is evaluated during the actual winding process and is adjusted to a predetermined set value by regulating the yarn tension and/or the contact force. Thus, it is possible to produce a high quality yarn package having a substantially uniform winding density.

In yet a further feature of the present invention the winding density is evaluated and maintained substantially constant through determination of an increase in a diameter of the yarn package, comparison of the determined diameter increase with a set value, and subsequent regulation of the yarn tension and/or contact force if a deviation results in order to adjust the determined value to the set value.

The present invention also includes an apparatus for the performance of the method of the present invention. In particular, a winding station of a winding machine includes an evaluation and regulation unit that is connected to the yarn tensioner and/or the device for generating the contact force for regulation of the yarn tension and/or contact force during at least one pattern winding zone of the winding process in order to maintain a constant winding density both during the pattern winding zone and outside of the pattern winding zone.

BRIEF DESCRIPTION OF THE DRAWINGS

Further features and benefits of the present invention will become apparent from the detailed description of the preferred embodiment and from the Figures, in which.

DETAILED DESCRIPTION OF THE PREFERRED METHOD AND EMBODIMENT

Figure 1:
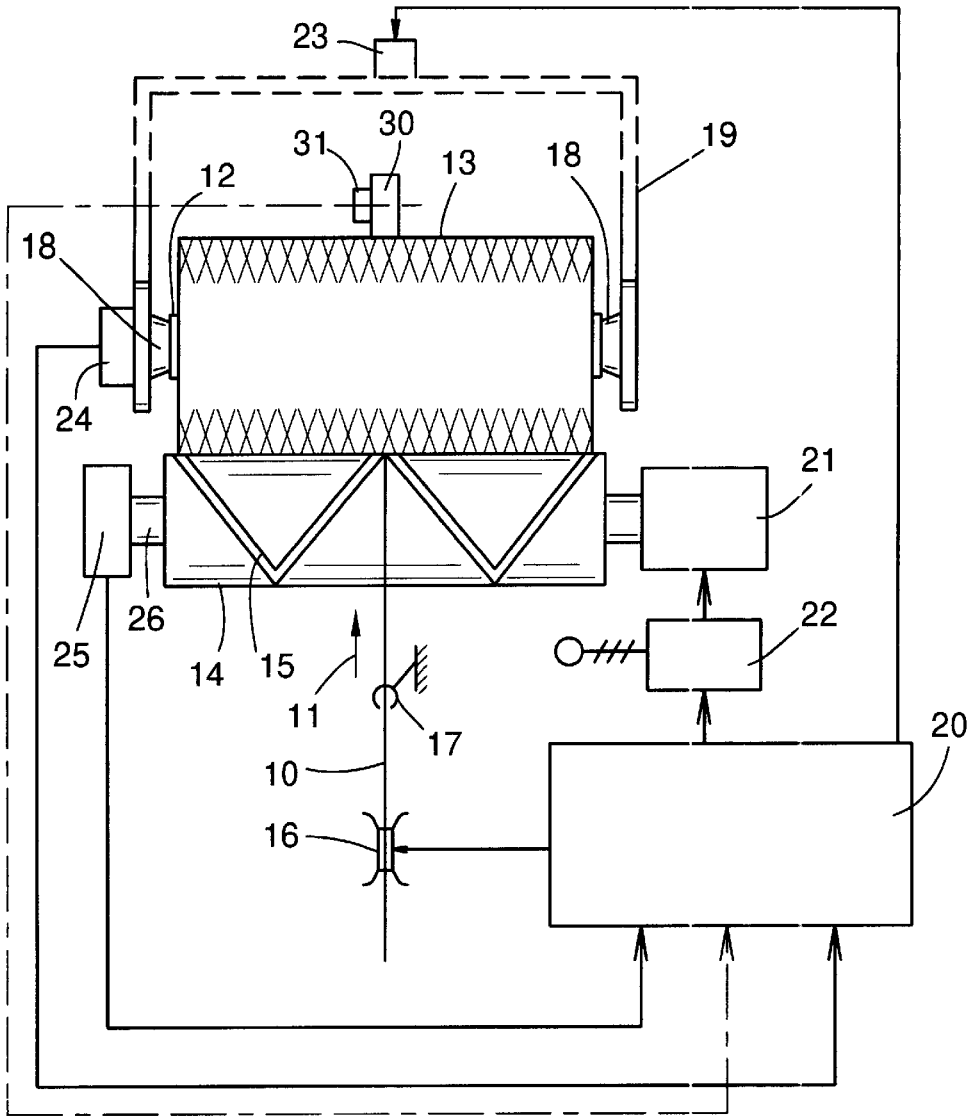
FIG. 1 is a schematic view of a winding station of the present invention.

At the winding station of a winding machine shown in FIG. 1, a yarn 10 is drawn the direction of arrow 11 and is wound on a bobbin core 12 to form a cylindrical yarn package 13. The cylindrical yarn package 13 rests on a friction roller 14, which is provided with a reversing groove 15 whereby the friction roller 14 simultaneously acts as a traversing guide. The yarn 10 runs over an adjustable and/or controllable yarn tensioner 16 to a yarn guide ring 17 and thereafter to the reversing groove 15 of the friction roller 14.

The yarn package 13 is held by cone plates 18 that project into the bobbin core 12 and rotate with the bobbin core 12 and therefore with the yarn package 13. The cone plates 18 are rotatably seated in a bobbin frame 19 whereby the yarn package 13 rests with a preselectable force on the friction roller 14.

The winding station includes an evaluation and regulation unit 20 that sets the velocity of a drive motor 21, embodied as an asynchronous motor, for driving the friction roller 14 through an inverted rectifier 22. The evaluation and regulation unit 20 also controls the adjustable yarn tensioner 16, represented only schematically, whereby the yarn tension can be set and, in particular, maintained at a constant value except when regulated by the evaluation and regulation unit 20 during a pattern winding zone.

The bobbin winding frame 19 is also provided with a device 23, only represented schematically, that generates a contact force with which the yarn package 13 rests on the friction roller 14. The device 23 can operate autonomously, i.e., automatically provide, as a function of yarn package diameter, maintenance of an at least approximate constant contact force. However, in the preferred method and embodiment the device 23 is controlled by the evaluation and regulation unit 20 to provide a constant contact force during the winding process except when regulated by the evaluation and regulation unit 20 during a pattern winding zone.

Angle of rotation sensors 24,25 are associated with one cone plate 18 and the shaft 26 of the friction roller 14, respectively, and are connected with the evaluation and regulation unit 20 for communication therewith.

In defined diameter conditions of the friction roller 14 and the yarn package 13, which can be calculated in advance, so-called pattern winding zones, patterns or lozenges occur which can be particularly troublesome in later unwinding of the yarn 10 from the yarn package 13. Pattern disruption methods are therefore employed which prevent such patterns or lozenges or, at least, reduce the negative effects of the patterns or lozenges. For instance, a conventional pattern disruption method includes alternately accelerating the friction roller 14 so that slippage occurs between the friction roller 14 and the yarn package 13, and then decelerating the friction roller 14 so that no slippage occurs between the friction roller 14 and the yarn package 13. However, even in spite of such a pattern disruption method, a relatively substantial increase in the winding density of the yarn package occurs in the area of the pattern winding zone which continues to adversely affect the unwinding behavior of the yarn package 13.

Figure 4:
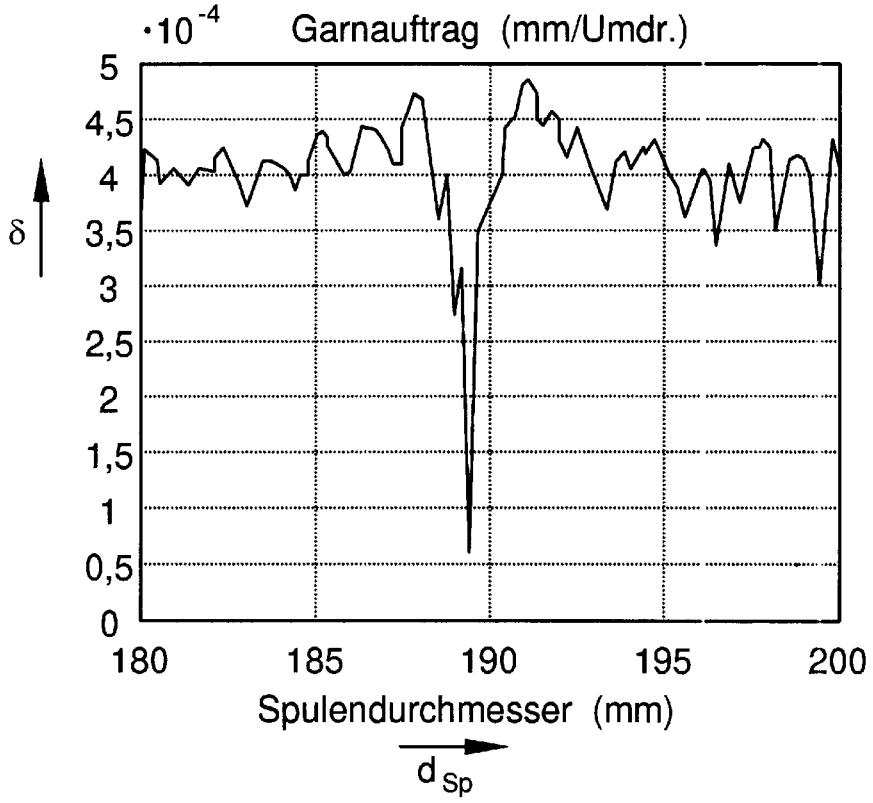
FIG. 4 is a graph of yarn application values plotted against yarn package diameter for a portion of the winding process that includes a pattern winding zone in which a substantial increase in the winding density occurs.

An increase in the winding density during a pattern winding zone can be detected by monitoring yarn application of the yarn package being wound, which is defined as one-half the change in the yarn package diameter for each revolution of the yarn package. Values for yarn application are graphed against yarn package diameter in FIG. 4 where the diameter ranges between 180 mm and 200 mm. As clearly shown in FIG. 4, the yarn application values substantially decrease in the area of a yarn package diameter of 190 mm which corresponds to an area of a pattern winding zone. The substantial decrease in the yarn application indicates a substantial increase in the winding density of the yarn package in this diameter range, i.e., during the area of the pattern winding zone.

In order to at least somewhat reduce this increase in winding density in accordance with the present invention, the winding process parameters are regulated when a pattern winding zone is encountered. In particular, the regulation of the winding process parameters preferably occurs by reducing the yarn tension and/or reducing the contact force of the yarn package 13 on the friction roller 14. The yarn tension can be reduced by slightly opening the yarn tensioner 16 and/or reducing the speed of the drive motor 21 and, thus, the winding speed of the friction roller 14. Proper regulation of the winding process parameters through, for example, proper yarn tensioning, results when a substantially uniform yarn application is achieved during the pattern winding zone.

Furthermore, experience has shown that, as a general rule, it is sufficient to limit regulation of the winding process parameters to areas of pattern winding zones having large yarn package diameters since, on the one hand, the pattern winding zones are more rapidly passed at smaller diameters and, on the other hand, the increase in winding density is not comparatively great at smaller diameters.

In accordance with a first feature of the present invention, the extent of the reduction of the yarn tension and/or the reduction of the contact force is stored in the form of a program in the evaluation and regulation unit 20 whereby the program predetermines the course and amount of the yarn tension change and/or of the contact force change required to maintain a uniform winding density. The time of a pattern winding zone, which can be precalculated as, for example, a function of the time of the winding process (start of winding an empty bobbin core 12 until the completion of a full yarn package 13), can also be stored in the evaluation and regulation unit 20 whereby the program can be called up at an appropriate time.

In an alternative embodiment the time of a pattern winding zone is detected during the actual winding process. This is done, for example, by evaluating the signals of the angle of rotation sensors 24,25 in the evaluation and regulation unit 20 in a manner as taught by German Patent Publication DE 42 39 579 A1.

Either way, the intervention in the winding process is preferably only performed in accordance with the preset program during the most critical pattern winding zone. However, it is also possible to perform a reduction of the yarn tension and/or the contact force in further, also critical winding pattern zones, wherein respective programs for the course and the magnitude of the intervention are called up in accordance with each critical pattern zone encountered. The suitable program(s) can be empirically determined in which values of the reduction of the yarn tension and/or the contact force prevent a decrease in winding density represented by the decrease of the yarn application in FIG. 4. Whether and to what extent an improvement has been made can also be noted by reference to the properties of a yarn package produced.

Figure 2:
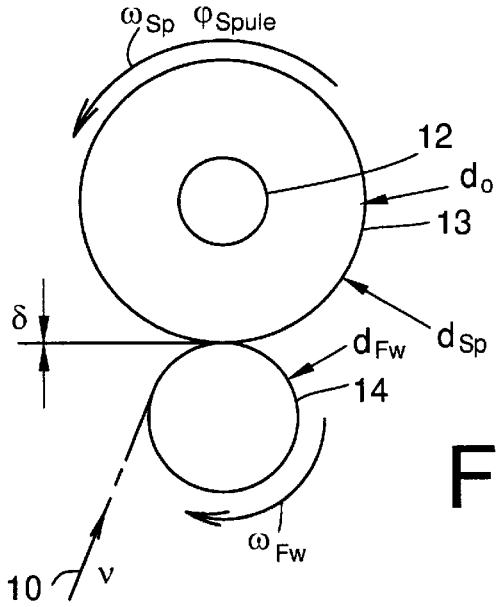
FIG. 2 is a schematic elevational view of a friction roller and of a yarn package of FIG. 1.

In connection with a further feature of the present invention the winding density is continuously monitored during the winding process and regulation of the winding process parameters is made when the winding density substantially deviates. As will be explained in more detail below, it is possible to monitor winding density during a winding process by monitoring an increase of the diameter of the yarn package 13, and more specifically, by calculating values representative of yarn application of the yarn package being wound, where yarn application "δ" is defined as one-half of the increase of the yarn package diameter for each revolution of the yarn package 13. The friction roller 14 and the yarn package 13, together with the actual values to be detected in connection with the calculation of the yarn application δ for the yarn package 13 being wound, are schematically represented in FIG. 2. Since the yarn application δ is very small in relation to the previous diameter $d_o$, the following equation (Eq. #1) applies:

$$d_{sp}=d_o+2\times\delta_i\times n_{sp}$$

where:

$d_{sp}$ is the instantaneous diameter of the yarn package 13;

$d_o$ is the previously determined diameter of the yarn package 13;

$\delta_i$ is the instantaneous yarn application value; and $n_{sp}$ is the number of revolutions of the yarn application occurring after the previously determined yarn package diameter.

Additionally, the following equation (Eq. #2) applies for a slippage-free state between the friction roller 14 and a yarn package 13:

$$d_{sp}=\frac{\omega_{FW}}{\omega_{sp}}\times d_{FW}$$

where:

$\omega_{FW}$ is the angular velocity of the friction roller 14;

$\omega_{sp}$ is the angular velocity of the yarn package 13; and $d_{FW}$ is the diameter of the friction roller 14, which is known.

Figure 3:
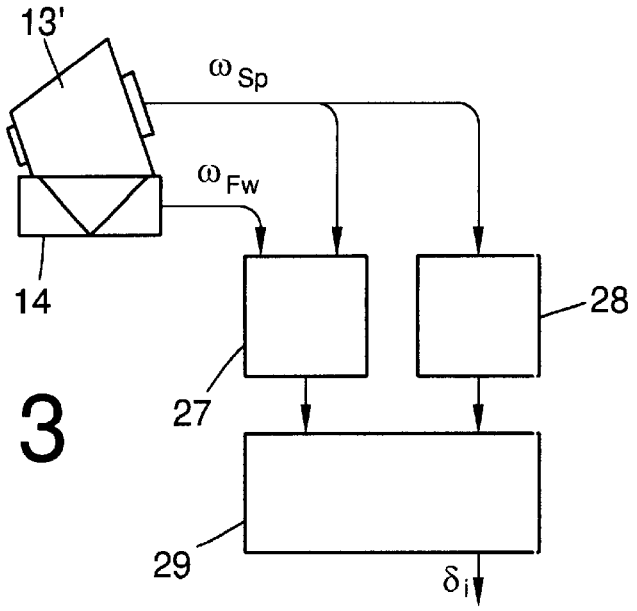
FIG. 3 is a schematic view of a winding station illustrating in block diagram an evaluation and control device for the monitoring of a diameter increase based on calculated yarn application values.

An evaluation and regulation 20 device for determining the yarn application δ of a yarn package 13' being wound is represented in block diagram in FIG. 3. Since the method and apparatus of the present invention can be used for conical yarn packages, a conical yarn package 13' together with a friction roller 14 is shown in FIG. 3. Furthermore, it should be noted that the present invention may be used with either a cylindrical yarn package 13 or with a conical yarn package 13'. In case of the latter, reference to diameter $d_{sp}$ of the conical yarn package 13' is to be understood as reference to the driven diameter of the conical yam package 13', i.e., the diameter at which no slippage occurs between the friction roller 14 and the yarn package 13'.

The angular velocities $\omega_{sp}$ and $\omega_{FW}$ are evaluated as shown in FIG. 3 in a device 27 of the evaluation and regulation unit 20 in accordance with Eq. #2. Since the diameter $d_{FW}$ of the friction roller 14 is constant, a multiplication by this diameter can be omitted. The angular velocity $\omega_{sp}$ of the yarn package 13' is furthermore supplied to a revolution counter 28. The two values of the device 27 and the revolution counter 28 are then supplied to a mathematical filter 29 developed from Eq. #1, which then calculates the yarn application $\delta_i$ of the yarn package 13' being wound at that instant.

If the value $\delta_i$ of the yarn package being wound at that instant deviates by a significant amount from a set value, and if the evaluation and regulation unit 20 simultaneously determines on the basis of the measured angular velocities $\omega_{sp}$ and $\omega_{FW}$, for example, that a pattern winding zone has been encountered, then an intervention in the winding process is performed in accordance with the present invention, i.e., the yarn tension and/or the contact force is reduced. Preferably the set value for the yarn application is determined from previously measured values of the yarn application $\delta_i$ occurring in a pattern-free zone. It is also possible to intervene in accordance with a predetermined program in the winding process, i.e., to change the yarn tension and/or the contact force by a predetermined course and a predetermined amount, in the area of a pattern winding zone, i.e., at a distance from the exact value of a pattern zone winding. However, it is preferred to regulate the yarn application to match an approximately constant value of the yarn application δ in the area of a pattern zone by an intervention in the yarn tension and/or the contact force.

With an appropriate design of the evaluation and regulation unit 20, the above explained performance of the detection of the diameter increase or of the yarn application δ during the winding process can also easily be performed over time, and not as a function of the number of revolutions of the yarn package. In place of the Eq. #1 the following equation (Eq. #3) is employed:

$$d_{sp}=\sqrt{d_o^2+\frac{4}{\pi}\times\delta\times\upsilon\times t}$$

where:

ν is the winding speed or the circumferential velocity of the friction roller

14; and t is the winding time or spooling time.

In this case a mathematical filter 29 is developed from Eq. #3 rather than from Eq. #1.

The derivation of Eq. #3 is explained in detail in Hermanns et al., U.S. patent application, Ser. No. 08/883,833, filed on Jun. 26, 1997, corresponding to German patent application P 196 25 511.2, currently pending in the U.S. Patent & Trademark Office, which U.S. patent application is hereby incorporated by reference.

In practice it is simplest to determine the angular velocities or rpm or period lengths of the friction roller 14 and the yarn package 13 by angle of rotation sensors 24,25. However, it is also possible to calculate the yarn application δ by a device for detecting another measurement such as, for example, a device for measuring the circumferential velocity of the yarn package 13. Such a device is indicated by a roller 30 resting against the circumference of the yarn package 13 in FIG. 1 which includes an angle of rotation indicator 31. It is thereby possible to calculate through a comparable calculating method the instant yarn application δ of the yarn package being wound.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method of producing a random wound yarn package at a winding station of a winding machine comprising:

(a) winding yarn onto a yarn package by driving the yarn package with a friction roller in a winding process;

(b) applying yarn tension in the yarn being wound;

(c) applying contact force between the friction roller and the yarn package; and (d) during a time period of a pattern winding zone of the winding process, (i) employing a pattern disruption method, and in combination therewith, (ii) varying at least one of the yarn tension applied and the contact force applied by predetermined amounts in order to maintain a substantially constant winding density of the yarn package.

2. The method in accordance with claim 1, wherein said varying includes varying both the yarn tension applied and the contact force applied by predetermined amounts during the time iperiod of the pattern winding zone.

3. The method in accordance with claim 1, wherein said varying at least one of the yarn tension applied and the contact force applied by predetermined amounts is performed by a predetermined program of an evaluation and regulation unit of the winding station which is called up when the pattern winding zone is encountered.

4. The method in accordance with claim 1, further comprising storing the time period during the winding process of the pattern winding zone in an evaluation and regulation unit of the winding station.

5. A method of producing a random wound yarn package at a winding station of a winding machine comprising:

(a) winding yarn onto a yarn package by driving the yarn package with a friction roller in a winding process;

(b) applying yarn tension in the yarn being wound;

(c) applying contact force between the friction roller and the yarn package; and (d) during a time period of a pattern winding zone of the winding process, (i) employing a pattern disruption method, and in combination therewith, (ii) monitoring winding density of the yarn package being wound and, based on said monitoring, varying at least one of the yarn tension applied and the contact force applied by predetermined amounts in order to maintain a substantially constant winding density of the yarn package.

6. The method in accordance with claim 5, wherein said step of monitoring includes detecting winding characteristics of the yarn package being wound during the time period of the pattern winding zone and calculating a value representative of the winding density of the yarn package being wound, said step of varying including varying the yarn tension and contact force when said calculated value representative of the winding density deviates from a predetermined value.

7. The method in accordance with claim 6, wherein said step of detecting winding characteristics includes counting revolutions of the yarn package, and measuring angular velocity of the friction roller and angular velocity of the yarn package when no slippage occurs between the yarn package and the friction roller, and wherein said step of calculating a value representative of winding density comprises calculating yarn application of the yarn package based on said detected winding characteristics.

8. The method in accordance with claim 6, wherein said step of detecting winding characteristics includes measuring winding time and circumferential speed of the yarn package, and measuring angular velocity of the friction roller and angular velocity of the yarn package when no slippage occurs between the yarn package and the friction roller, and wherein said step of calculating a value representative of winding density comprises calculating yarn application of the yarn package based on said detected winding characteristics.

9. The method in accordance with claim 6, wherein said step of detecting winding characteristics includes counting revolutions of the yarn package, and measuring angular velocity and circumferential speed of the yarn package, and wherein said step of calculating a value representative of winding density comprises calculating yarn application of the yarn package based on said detected winding characteristics.

10. The method in accordance with claim 6, wherein said step of detecting winding characteristics includes measuring winding time and circumferential speed of the yarn package, and measuring angular velocity of the yarn package, and wherein said step of calculating a value representative of winding density comprises calculating yarn application of the yarn package based on said detected winding characteristics.

11. A winding station of a winding machine for the production of a random wound yarn package in a winding process, comprising:

a friction roller for driving a yarn package to be produced;

a yarn tensioner that generates yarn tension with which the yarn is wound onto the yarn package;

a device that generates contact force with which the yarn package rests on said friction roller; and an evaluation and regulation unit that includes means for varying at least one of the yarn tension generated by said yarn tensioner and the contact force generated by said device during the time period of a pattern winding zone when a pattern disruption method is employed in the winding process in order to maintain a substantially constant winding density of the yarn package during the pattern disruption method.

12. An apparatus in accordance with claim 11, wherein said means varies both the yarn tension generated by said yarn tensioner and the contact force generated by said device.

13. An apparatus in accordance with claim 11, wherein said evaluation and regulation unit includes memory for retaining a program that regulates said yarn tensioner and said device during said time period of the pattern winding zone when the pattern disruption method is employed.

14. An apparatus in accordance with claim 11, wherein said evaluation and regulation unit includes memory for retaining the time period of the pattern winding zone in the winding process.

15. An apparatus in accordance with claim 11, further comprising at least one sensor that detects winding characteristics of the yarn package including at least one of the group of angular velocity, period, frequency, and circumferential velocity, said at least one sensor being disposed for communicating the detected winding characteristics to said evaluation and regulation unit.

16. An apparatus in accordance with claim 15, wherein said evaluation and regulation unit includes means for calculating yarn application of the yarn package being wound based on the detected values of said at least one sensor.

17. An apparatus in accordance with claim 16, wherein said evaluation and regulation unit includes means for evaluating said calculated yarn application whereby said yarn tensioner and said device are varied when said calculated yarn application deviates from a predetermined value.

18. A method of producing a random wound yarn package at a winding station of a winding machine comprising:

(a) winding yarn onto a yarn package by driving the yarn package with a friction roller in a winding process;

(b) applying yarn tension in the yarn being wound;

(c) applying contact force between the friction roller and the yarn package; and (d) during a time period of a pattern winding zone of the winding process, (i) employing a pattern disruption method, and in combination therewith, (ii) performing a step for maintaining a substantially constant winding density of the yarn package by varying at least one of said applied yarn tension and said applied contact force.

* * * * *